United States Patent [19]

Buschulte et al.

[11] Patent Number: 4,629,414

[45] Date of Patent: Dec. 16, 1986

[54] HOT GAS GENERATING BURNER

[75] Inventors: Winfried Buschulte, Neuenstadt; Erich Adis, Heilbron-Neckargartach; Manfred Bader, Neuenstadt, all of Fed. Rep. of Germany

[73] Assignee: Deutsche Forschungs- und Versuchsanstalt für Luft- und Raumfahrt e.V., Bonn, Fed. Rep. of Germany

[21] Appl. No.: 763,824

[22] Filed: Aug. 8, 1985

[30] Foreign Application Priority Data

Aug. 16, 1984 [DE] Fed. Rep. of Germany ..... 3430010

[51] Int. Cl.[4] ..... F23D 13/40

[52] U.S. Cl. ..... 431/46; 431/265; 431/353

[58] Field of Search ..... 431/116, 264, 265, 354, 431/115, 350, 353, 187; 432/222; 126/110 B

[56] References Cited

U.S. PATENT DOCUMENTS

| | | | |
|---|---|---|---|
| 2,857,961 | 10/1958 | Brown, III et al. | 431/116 |
| 3,545,902 | 12/1970 | Bailey | 431/116 X |
| 3,609,073 | 9/1971 | Robinson | 431/116 |
| 4,115,050 | 9/1978 | Gerwin | 431/265 X |
| 4,308,007 | 12/1981 | Buschulte | 431/116 |
| 4,364,725 | 12/1982 | Buschulte | 431/116 |
| 4,441,879 | 4/1984 | Wagner et al. | 431/265 X |
| 4,473,349 | 9/1984 | Kumatsu | 431/116 |

FOREIGN PATENT DOCUMENTS

| | | | |
|---|---|---|---|
| 2821932 | 11/1979 | Fed. Rep. of Germany | 431/265 |

*Primary Examiner*—Margaret A. Focarino
*Attorney, Agent, or Firm*—Kenway & Jenney

[57] ABSTRACT

The invention relates to a hot-gas generating burner comprising a nozzle discharging a fuel jet which then enters a mixing tube, and an orifice plate surrounding the outlet of the nozzle. The casing of the burner is divided by the orifice plate into an upstream-disposed precombustion chamber which includes the nozzle, and a downstream combustion chamber which contains the mixing tube. The orifice has a central passage for the fuel jet which is discharged from the nozzle and a number of openings surrounding the passage. In order to reduce the noise concomitant with the operation of the burner, the spacing between the peripheries of the neighboring openings equals at least 50% of the diameter of the openings, and/or the openings in the orifice plate are associated with at least one air duct in the direction of flow.

24 Claims, 10 Drawing Figures

HOT GAS GENERATING BURNER

BACKGROUND OF THE INVENTION

This invention relates to a hot gas generating burner comprising: a nozzle discharging a fuel jet which then enters a mixing tube; an orifice plate surrounding the outlet of the nozzle; a casing divided by the orifice plate into an upstream-disposed precombustion chamber which includes the nozzle, and a downstream-located combustion chamber which contains the mixing tube; the orifice plate having a central passage for the fuel jet which is discharged from the nozzle, and a number of openings surrounding the passage, the openings being adapted for the combustion air to flow from the precombustion chamber into the mixing tube, wherein the openings are located within a surface which is defined by a projection of the clear cross-sectional area of the mixing tube onto the orifice plate.

Burners of the above-described type are known from, e.g. German Pat. No. 27 00 671 and German Offenlegungsschrift No. 29 18 416.

In these prior-art burners, air is supplied to the fuel that is fed through a centrally-disposed nozzle. The air is supplied through openings provided in an orifice plate that surrounds the nozzle. Air and fuel are mixed in a mixing chamber downstream from the nozzle, the mixing chamber being situated in a mixing tube. In operation, a flame front is formed in the area of the downstream end of the mixing tube. Hot gases from the flame front flow back outside the mixing tube to a recirculation port on the upstream end of the tube.

Such a burner design has been proven to ensure excellent combustion, which is, however, still associated with a relatively high noise level.

The object of the present invention is so to arrange the above burner that the noise generated in the operation of a burner of the above-defined art is reduced.

SUMMARY OF THE INVENTION

This object is achieved in a burner of the above type such that the peripheral spacing of the neighbouring openings amounts to at least 50% of the opening diameter and/or the openings in the orifice plate are associated, in the direction of flow, with at least one air duct which, at least in the area of radially externally disposed edges of the openings, blends smoothly into the openings.

Both of these noise-reducing provisions are particularly effective when applied in combination. However, each provision separately also brings about a substantial reduction of the burner noise.

In the prior art designs, the openings in the orifice plate have been so arranged that the peripheries of neighbouring openings lie closely adjacent to each other, in order to provide as large as possible a passage area for combustion air. It has turned out, however, that an increase in the spacing of the openings results in a reduction of the noise. Accordingly, the spacing of the neighbouring openings in the circumferential direction of a pitch circle should amount to at least 50% of the diameter of the openings. Such an increase in the spacing of the combustion air openings results, by itself, in a suppression of the noise by a fed dB(A).

An air duct is arranged ahead of the openings to provide an approximately parallel combustion air flow before the air passes through the openings and enters the mixing chamber. This reduces the air flow disturbances and prevents turbulence being carried over into the mixing chamber. Otherwise, the turbulence would persist in the flame and in the recirculating stream and would result in an increased combustion noise level.

In a particularly advantageous embodiment of the invention, the longitudinal axes of the openings are convergently inclined relative to the longitudinal axis of the mixing tube in the direction of flow, the inclination being preferably between 3° and 6°. This can be accomplished solely by a corresponding arrangement of the openings in the orifice plate or through a deformation of the orifice plate resulting in the inclination of the longitudinal axes of the openings relative to the longitudinal axis of the mixing tube.

In a particularly simple embodiment, the air duct is formed by a pipe stub, or tubular portion, that surrounds the nozzle and is concentrically spaced therefrom. Consequently, all the openings are associated with a common air duct which is formed by an annular slot between the inner wall of the tubular portion and the nozzle. The annular slot may be disposed alongside of a cone that narrows in the direction of flow. This provision results additionally in the reduction of air stream turbulence, which is particularly advantageous when combined with an opening having an inclined longitudinal axis.

The noise-reducing effect of the tubular portion is particularly beneficial when the length of the tubular portion amounts to between 10 and 120% of its inner diameter in the area of the transition of the tubular portion to the openings. Preferably, this length should be 20–70% of the inner diameter, the most favourable range being 30–50%.

In a further embodiment of the invention, each opening is associated with a separate air duct which extends shock-free into the opening. Also in this case, the air ducts may be made conically convergent in the direction of flow.

A particular version of such a conically convergent air duct is obtained by chamfering of the openings, the chambers being made directly in the orifice plate. Surprisingly, the chambering of the openings in a multihole diaphragm leads by itself to a substantial noise reduction, since in this case the combustion air can flow shock-free into the mixing chamber.

The air ducts may be arranged on a cylindrical surface that surrounds the nozzle concentrically. In a modified embodiment, they are disposed on a conical surface surrounding the nozzle concentrically. In the latter case, it is advisable to arrange the longitudinal axis of the ducts at an angle of 3°–6° relative to the longitudinal axis of the mixing tube, since this results in an optimum mixing within the mixing tube without creating undesirable turbulence.

The air ducts may be incorporated in a common guide that surrounds the nozzle concentrically.

It has proven expedient to arrange that the length of the air ducts amounts to 0.5–4 times the radical spacing of the openings from the longitudinal axis of the nozzle, and most preferably 2–3 times this spacing.

In a further preferred embodiment of the invention, the orifice plate has an annular slot which surrounds the nozzle concentrically and is directly adjacent thereto, the annular slot being in communication with the precombustion chamber. The annular slot, directly surrounding the nozzle passage through the orifice plate, enables combustion air to flow into the mixing chamber in the proximity of the longitudinal axis of the nozzle.

The openings in the orifice plate may be circular in cross-section, but they may also be of a different shape, e.g. they may form ring sectors. The neighbouring openings may be disposed on a common circle around the longitudinal nozzle axis, and they may be staggered radially as well, so that they are situated on two concentric pitch circles and offset from each other.

The peripheral spacing of neighbouring openings should be greater then 50% of the opening diameter, preferably greater than 100% thereof. The higher the ratio of the spacing to the opening diameter, the greater the noise reduction which can be obtained.

In a preferred embodiment of the invention, the diameter of the upstream end of the mixing tube is greater than the diameter of its downstream end. The narrowing of the mixing tube may be a stepwise or conical one.

It is, furthermore, advantageous when the inner diameter of the upstream end of the mixing tube is greater than the diameter of a circumferential circle that encloses and is adjacent to the peripheries of the openings. In a modified embodiment, the inner diameter may be equal to the diameter of that circumferential circle.

It is advantageous for the length of the mixing tube to be up to three times the inner diameter of the inlet of the mixing tube. Thus, the mixing tube is somewhat longer than those normally in use. The extension of length of the mixing tube has proven to contribute to the noise reduction as well.

The extended mixing tube may have openings in its wall, the openings being adapted to receive an ignition device.

In a further preferred embodiment of the invention, recirculation ports are provided in the wall of the mixing tube at its upstream end which is connected to the orifice plate. The ports are spaced from the orifice plate so that a closed tubular portion is disposed between the orifice plate and the ports. Preferably, the length of the tubular portion is about $\frac{1}{4}$ of the diameter of the mixing tube. By means of such a configuration of the recirculation ports an increase in the mixing temperature is achieved, but on the other hand, it has an effect on the turbulence. Consequently, a drop in the total noise level will be noticed. For instance, as a result of the above provisions, the total noise level would decline by 0.5 to 1 db(A).

Further, another tubular portion may be connected to the mixing tube at its downstream end, the diameter of the tubular portion not exceeding the diameter of the downstream end of the mixing tube. Preferably, the tubular portion is spaced from the downstream end of the mixing tube by a distance of 1/10 to $\frac{1}{4}$ of the diameter of the mixing tube. Advantageously, the length of the tubular portion is equal to from one-half to one diameter of the mixing tube, preferably being equal to $\frac{2}{3}$ of that diameter. These features also contribute to a reduction in the total noise level, since the core flow of the gas, after leaving the large part of the mixing tube, is forced again through a constriction in order to suppress the turbulence occurring in the inner mixing cone of the flow.

It is emphasized again that the above-described provisions are particularly effective as noise reduction measures when applied together, in combination, but also each of the provisions relating to the supply of combustion air into the mixing tube contributes by itself to the desired noise reduction. Each of these provisions may be combined with each of the features concerning the design of the mixing tubes to bring about a further noise reduction. Therefore, the invention is claimed to ensure protection for the combination of all the features as well as some of them and also for the individual features concerning the supply of combustion air to the mixing tube.

BRIEF DESCRIPTION OF THE DRAWINGS

The invention is explained below in more detail in conjunction with the drawing, in which.

DETAILED DESCRIPTION OF THE INVENTION

This invention applies to many various oil or gas burners and is explained below based on an exemplary Bunsen type burner, i.e. a burner in which oil is burned completely with blue flame. The invention is not, however, limited to such burner type. The desired noise reduction may be obtained using the features defined herein, also in the case of, for instance, preheating burners or torches and yellow-flame burners.

Figure 1:
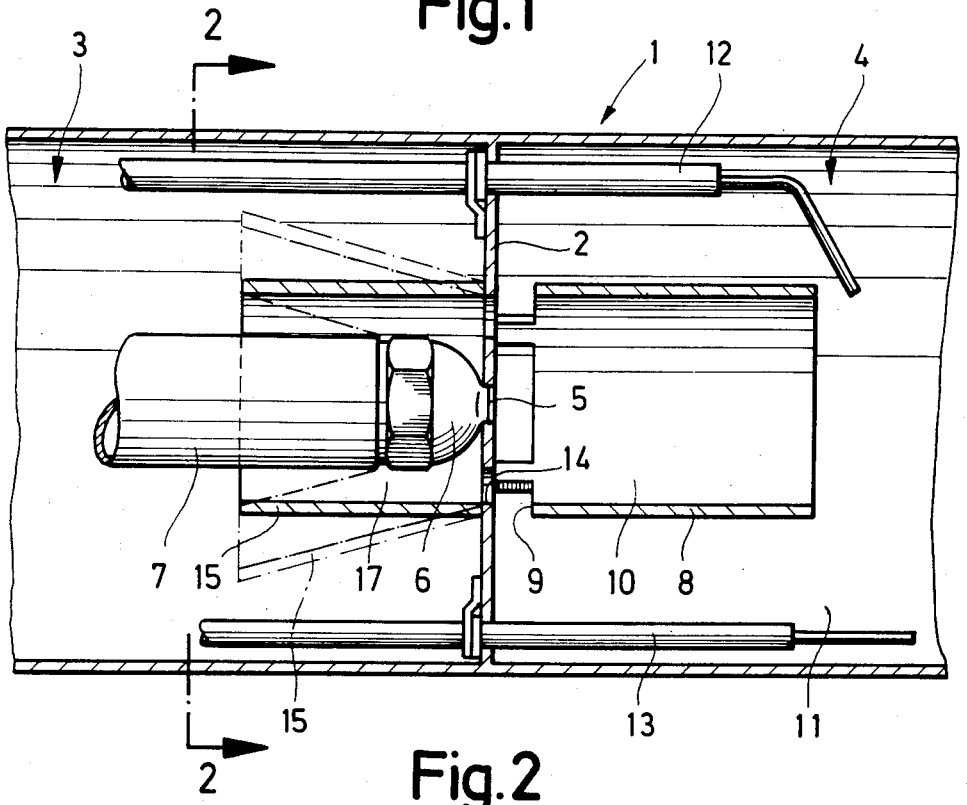
FIG. 1 is a longitudinal section of a first embodiment of the burner.
Figure 2:
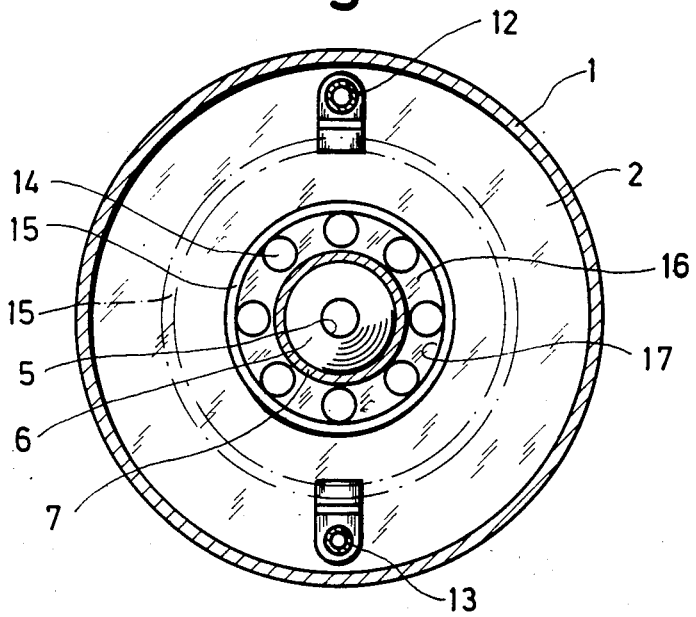
FIG. 2 is a section of the line 2—2 of FIG. 1.

The burner as illustrated in FIGS. 1 and 2 comprises a cylindrical casing 1 which is divided into an upstream-located precombustion chamber 3 and a downstream-located combustion chamber 4 by an orifice plate 2. The orifice plate 2 has a central passage 5 into which protrudes a nozzle 6 which is connected to a fuel supply conduit 7. The longitudinal axis of the nozzle coincides with the longitudinal axis of the casing 1.

The orifice plate 2 is connected on its downstream side to a cylindrical mixing tube 8 which comprises peripheral slots 9 directly adjacent to the orifice plate 2. The slots 9 provides communication between the inner space 10 of the mixing tube 8 and an annular space 11 which surrounds concentrically the mixing tube 8 and serves as a recirculation space.

An ignition device 12 extends from the recombustion chamber through the orifice plate 2 up to the outlet end of the mixing tube 8, to enable an ignition to occur in that area, if necessary.

Similarly, a measuring probe 13 extends from the precombustion chamber through the orifice plate 2 into the combustion chamber.

A plurality of circular openings 14 is disposed along the pitch circle which surrounds concentrically the central passage 5 in the orifice plate 2. The openings 14 provide a communication between the precombustion chamber 3 and the inner space 10 surrounded by the mixing tube 8. The nozzle 6 is surrounded by and spaced from a cylindrical pipe stub 15 which extends up to the orifice plate 2. As clearly shown in FIG. 2, the inner diameter of the pipe stub 15 is selected so that its inner wall extends smoothly into the openings 14 in the area of the externally disposed edges of the openings. It can also be seen in FIG. 2 that the radius of the circle along which the openings are disposed is longer than the outer radius of the nozzle 6 and shorter than the radius of the inner wall of the pipe stub 15. Thus, the openings 14 touch the sheathing of the nozzle in the inner area of their edges and contact the inner wall of the pipe stub 15 with the outer area of their edges.

The number of the openings 14 along the circle that surrounds the nozzle is so selected that bridges 16 are left between the openings, the width of the bridges being at least 50% of the diameter of the openings 14. It is particularly preferable that the inner diameter of the pipe stub 15 be slightly smaller than the inner diameter of the mixing tube 8. This allows, at a predetermined cross-sectional area of the openings 14, for a maximum circumferential spacing of the neighbouring openings, such maximum spacing resulting in an optimum noise reduction. As the inner diameter of the pipe stub becomes greater than the inner diameter of the mixing tube, the noise level begins to rise despite the greater spacing of the openings.

In operation, a fuel, e.g. gas or oil, flows through the nozzle 6 into the cavity. In the case where oil is used, the nozzle may be an atomizer jet, or atomizer nozzle. Combustion air is supplied through the openings 14 into the inner space 10 of the mixing tube 8, whereby fuel and combustion air become homogeneously mixed together in the space 10. The mixture is ignited at the outlet end of the mixing tube 8 and forms a flame front which is located in the area of the outlet end of the mixing tube depending on the respective flow velocity.

The pipe tube 15 forms an annular channel 17 surrounding the nozzle 6. The combustion air passes through the annular channel 17 before entering the inner space of the mixing tube 8 through the openings 14. The air stream stabilizes during its flow through the annular channel 17 so that eventually the air stream is no longer turbulent when it passes through the openings 14. This also results in a better turbulence in the mixing tube 8 and in the combustion rebion compared to a design where air is passed from the precombustion chamber directly into the mixing tube 8 without a guiding channel preceding the openings 14. Due to low turbulence, a marked noise reduction is obtained in the combustion process itself.

In the embodiment shown in FIG. 1, the pipe stub 15 is of a cylindrical shape (solid lines). In a modified embodiment, the pipe stub 15 has a frusto-conical shape, and a parallel inner wall forms, with the pipe stub, an annular slot 17 extending along a frusto-conical surface. Such a design, illustrated in FIG. 1 with broken lines, contributes additionally to the stabilization of the air stream.

Figure 3:
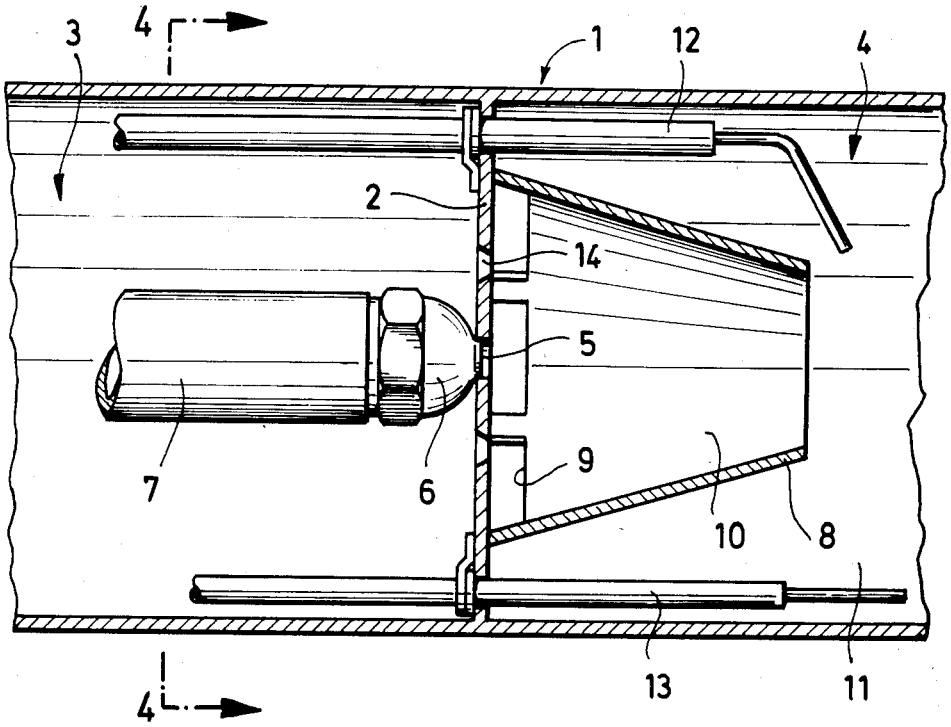
FIG. 3 is an elevation, similar to FIG. 1, of another embodiment of the burner.
Figure 4:
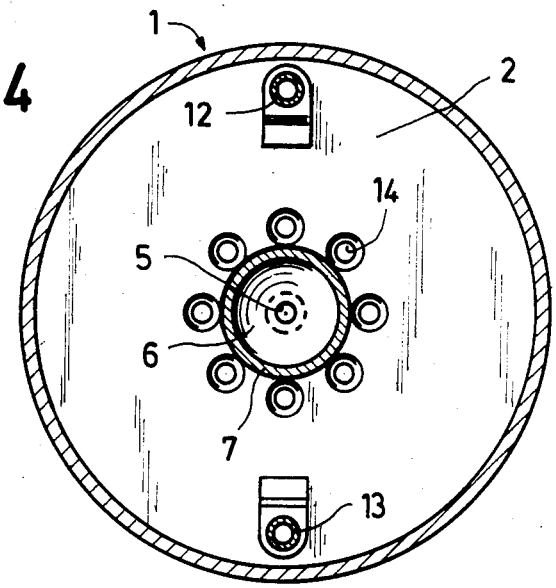
FIG. 4 is an elevation in section of the line 4—4 of FIG. 3.

FIGS. 3 and 4 illustrates a similar burner, wherein corresponding elements are designated with identical reference numerals.

In this embodiment, the mixing tube 8 is of a frusto-conical shape, wherein the diameter of its inlet end is considerably greater than the diameter of the pitch circle on which the openings 14 are distributed. Such conical tapering of the mixing pipe has proven effective in a further reduction of noise emitted in the combustion process.

In the embodiment illustrated in FIGS. 3 and 4 there is no air supply channel comparable to the pipe stub 15. Instead, the openings 14 are chamfered on their side facing the precombustion chamber 3. The chamferings, which are worked directly in the orifice plate 2, also form air supply channels which contribute to a considerable stabilization of the combustion air stream entering the mixing tube and thereby to a noise reduction as well. The chamfering itself is an effective noise-reduction measure, however, it is particularly efficient when combined with other preceding air supply channels, e.g. with the pipe stub 15 of the embodiment shown in FIGS. 1 and 2.

Figure 5:
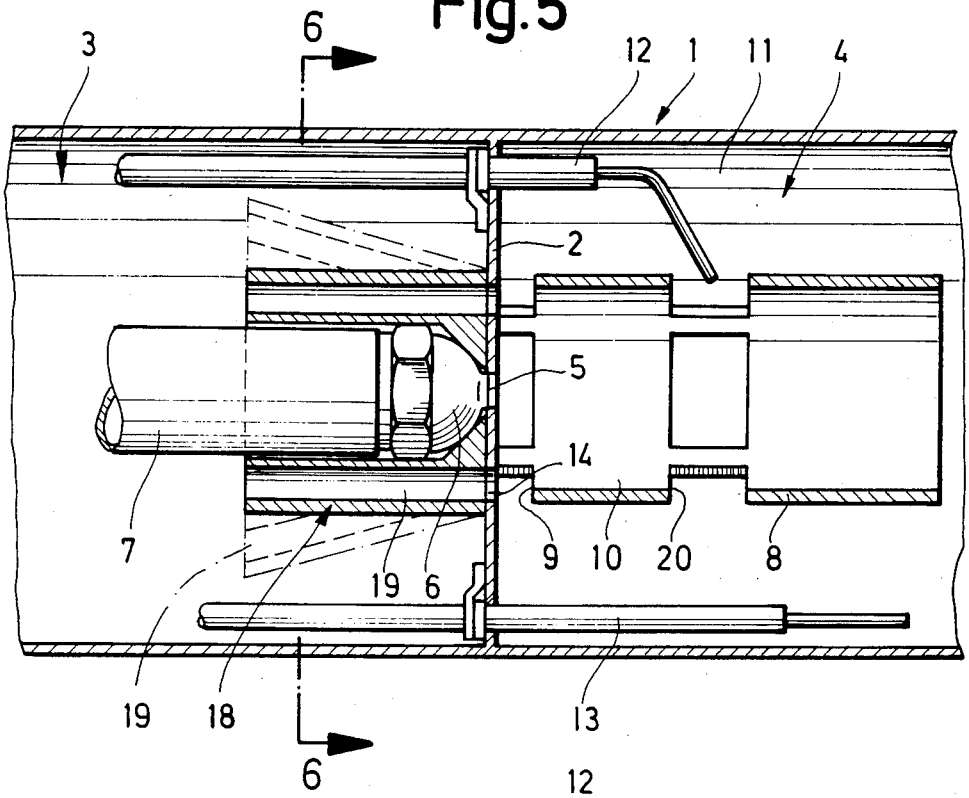
FIG. 5 is a view, similar to that in FIG. 1, of another embodiment.
Figure 6:
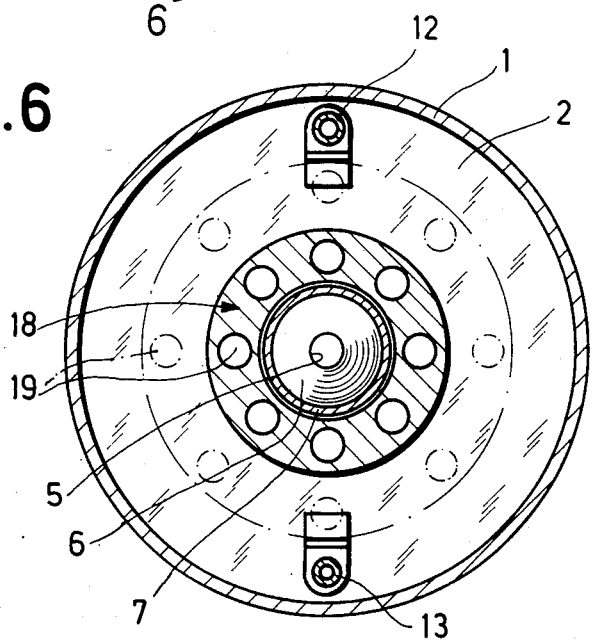
FIG. 6 is an elevation of the line 6—6 in FIG. 5.

In the embodiment shown in FIGS. 5 and 6 where corresponding elements are designated with the same reference numerals, the nozzle is surrounded by a guide 18 in which paraxial channels 19 are provided so that each opening 14 is associated with a corresponding channel 19. The channels 19 extend smoothly into the respective openings 14.

In the embodiment shown, the channels 19 have a uniform diameter over their entire length; however, channels that narrow in the flow direction may be provided instead.

As shown in FIG. 5 with solid lines, the channels 19 may pass parallel through the guide 18, but they may alternatively be disposed on a conical surface as shown in FIG. 4 with broken lines. It is further expedient when the channels 19 are inclined in relation to the longitudinal axis of the nozzle at an angle between 3° and 6°. It has been proven that an optimum noise reduction can be obtained due to such an arrangement. Even in this case, the channels may also be narrowed in the direction of flow. In this connection, it is important that the channels 19 in all cases extend smoothly into the openings 14, so that no turbulence occurs in the transition area.

In the embodiment illustrated in FIG. 5, the mixing tube 8 is extended as compared with the embodiments of FIGS. 1 to 4, so that its length is approximately up to three times the inner diameter of the inlet of the mixing tube. The elongation of the mixing tube contributes also to an additional noise reduction. In order to enable an ignition to occur in an area of the elongated mixing tube closer to the orifice plate 2, the mixing tube has openings 20 in its wall, and the ignition device 12 protrudes into the inner space 10 of the mixing tube 8 through these openings 20 which are located between the upstream end and the downstream end of the mixing tube.

Figure 7:
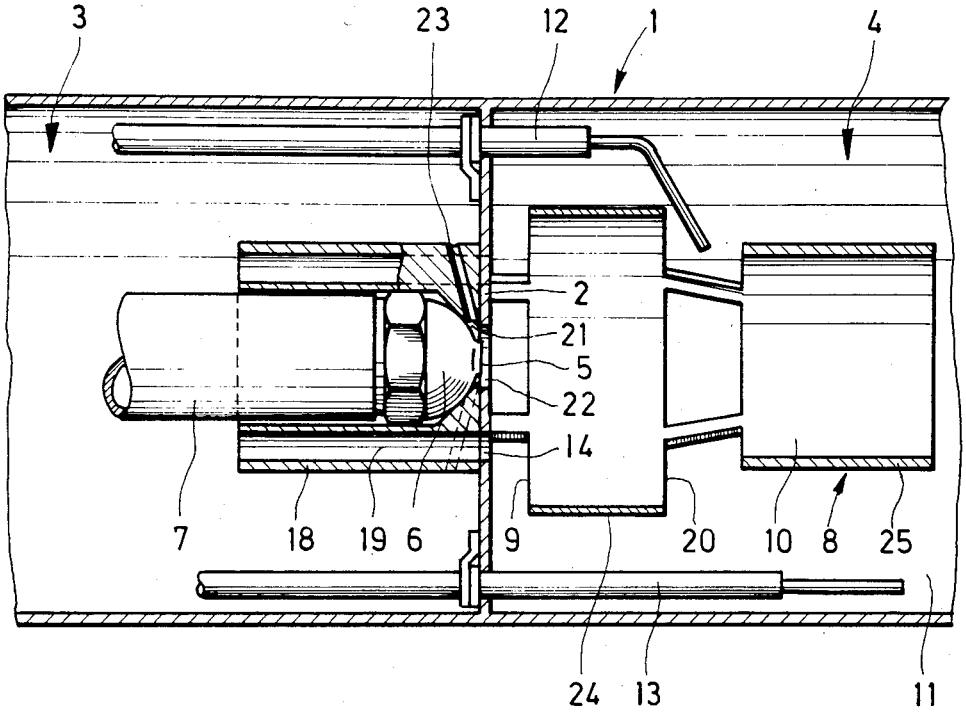
FIG. 7 is a view, similar to that in FIG. 1, of a further preferred embodiment of the burner.

As shown in FIG. 7, there is provided in the guide 18 an annular space 21 that surrounds the nozzle 6 in the region of the passage 5. The annular space 21 opens into an annular slot 22 which surrounds the passage 5. The annular slot 22 can be formed by the passage 5 alone. In such a case, the diameter of the passage 5 is somewhat greater than the diameter of the nozzle 6 in that area.

The annular space 21 is in communication with the precombustion chamber 3 via channels 23 which pass essentially radially through the guide 18. Consequently, combustion air can enter the inner space not only through the channels 19 and the openings 14, but also through the channels 23, the annular space 21 and the annular slot 22. As the combustion air enters the inner space in the direct vicinity of the fuel, a particularly effective mixing results, wherein turbulences are stabilized to a large degree before the combustion air enters the inner space. This provision also contributes to a reduction in the combustion noise.

The mixing tube 8 is extended as in the embodiment shown in FIG. 5 and has openings 20 in its wall. Moreover, the part 24 of the mixing tube located upstream of the opening 20 has a greater diameter than the downstream part 25 of the mixing tube. The diameter of the part 24 is also considerably greater than the diameter of the pitch circle of the openings 14. Consequently, this embodiment includes the features of the embodiments of FIGS. 3 and 5, the narrowing of the mixing tube and also the extension thereof.

In all the above embodiments, the axes of the openings 14 are parallel to the longitudinal axis of the mixing tube 8. It is possible, however, to arrange the openings in the orifice plate in such a manner that their longitudinal axes are convergently inclined against the longitudinal axis of the mixing tube in the direction of flow, the inclination being, for instance, from 3° to 6°. The inclination can be accomplished by way of a corresponding working of the openings into the orifice plate or by means of a deformation of the orifice plate in the region of the openings 14. It has turned out that the small inclination of the longitudinal axes of the openings and thus the inclination of the combustion air flow against the longitudinal axis of the mixing tube, with simultaneous improvement of the air-fuel mixing, results in an additional reduction of the combustion noise.

Owing to the above-described design features, the combustion air can be passed into the mixing chamber virtually turbulence-free, so that a considerable noise reduction can be obtained. By way of example, the total noise level may be reduced by 8 to 10 dB(A) of the absolute value as compared with other burners in which combustion air is passed directly, without protective measures, through the openings in the orifice plate into the mixing chamber.

Figure 8:
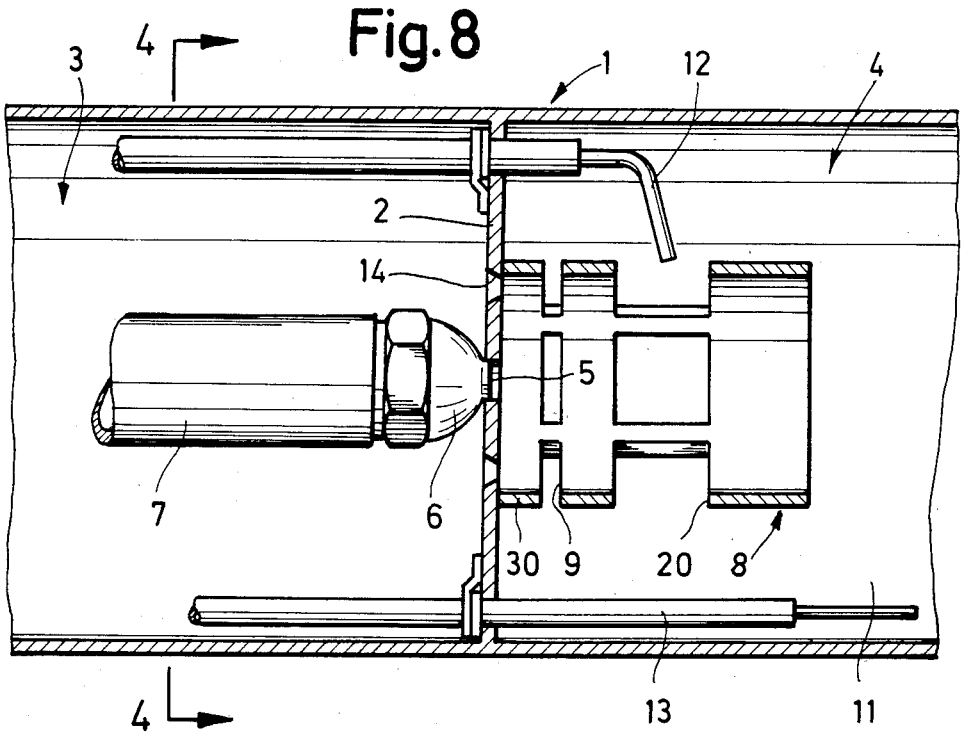
FIG. 8 is a view, similar to that in FIG. 1, of another embodiment.

The embodiment shown in FIG. 8 is similar to that of FIG. 3 as far as the design of the precombustion chamber and the air inlet channels is concerned. In the area of the combustion chamber 4, the burner differs from the embodiment of FIG. 5 only by the spacing between the peripheral slots 9 and the orifice plate 2, a tubular portion 30 with closed tubular surface being provided between the plate 2 and the slots 9.

The length of the tubular portion 30 is approximately ¼ of the diameter of the mixing tube. This provision has proven to have a noise-reducing effect on the turbulence in the mixing tube.

Figure 9:
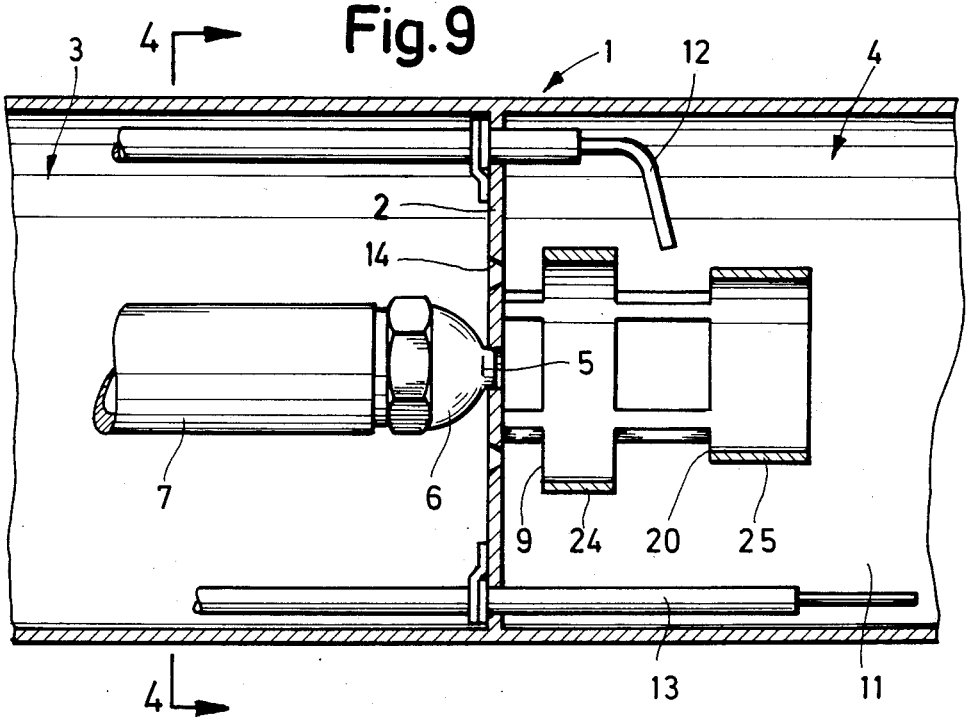
FIG. 9 is a view, similar to that in FIG. 1, of still another embodiment.

The embodiment of FIG. 9 is similar to that of FIG. 8 in the area of the precombustion chamber. As far as the combustion chamber 4 is concerned, the design differs from the embodiment of FIG. 7 only in that the inner diameter of the upstream part 24 of the mixing tube 8 corresponds to the diameter of the circumferential circle that surrounds and is adjacent to the peripheries of the openings 14. The inner diameter of the downstream part 25 is correspondingly smaller. This provision also contributes to the reduction of the total noise level.

Figure 10:
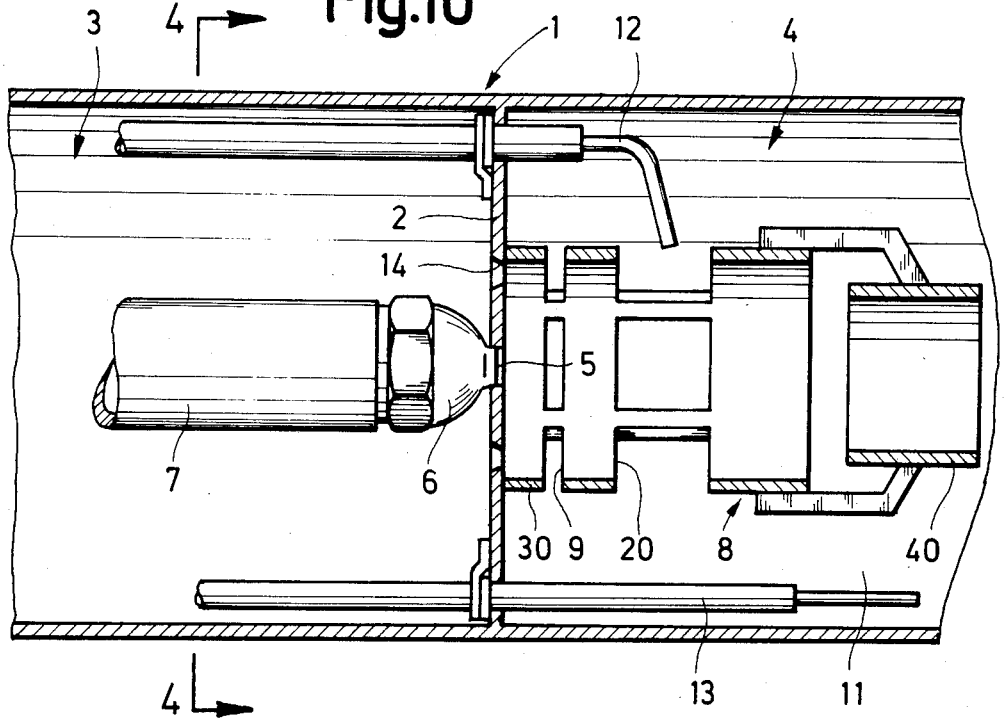
FIG. 10 is a view, similar to that in FIG. 1, of yet another embodiment of the invention.

The embodiment of FIG. 10 corresponds largely to the embodiment shown in FIG. 8, the only difference being in a further tubular portion 40 which is connected coaxially to the mixing tube 8 and is spaced from its end, the spacing being from 1/10 to ¼ of the diameter of the mixing tube. The length of the tubular portion 40 is equal to between one-half and one diameter of the mixing tube, preferably to ⅔ of the diameter. The inner diameter of the tubular portion 40 may be equal to the inner diameter of the mixing tube 8 at its outlet. However, the inner diameter of the tubular portion 40 is preferably smaller, as shown in FIG. 10.

After leaving the mixing tube, the core stream of gases is forced again through the constriction formed by the added tubular portion 40, wherein the turbulence occurring in the inner burner cone (mixing cone) is suppressed. This also contributes to reduction of the total noise level.

The particular, different features of the mixing tube may also be combined in another way. For instance, the mixing tube may have staggered peripheral slots 9 located downstream and a tubular portion 40 attached at the downstream end, wherein the mixing tube may also be tapered in the direction of flow.

Additionally, the various embodiments of the mixing tube may be arbitrarily combined with the various designs of the precombustion chamber as explained in this specification.

The embodiments of the invention in which an exclusive property or privilege is claimed are defined as follows:

1. A hot-gas generating burner comprising: a nozzle from which a fuel jet outflows and enters a mixing tube, an orifice plate surrounding the outlet of the nozzle, a casing divided into an upstream precombustion chamber containing the nozzle and a downstream combustion chamber containing the mixing tube, the orifice plate having a central passage for the fuel jet that outflows from the nozzle and a number of openings surrounding the passage, through which openings combustion air flows from the precombustion chamber into the mixing tube, wherein the openings are located within a surface which is defined by a projection of the clear cross-sectional area of the mixing tube onto the orifice plate, the spacing between the peripheries of the neighbouring openings amounting to at least 50% of the opening diameter and the openings in the orifice plate being associated, in the direction of flow, with at least one air duct which, at least in the area of the radially externally disposed edges of the openings, extends smoothly into the openings.

2. A burner according to claim 1, wherein the longitudinal axes of the openings are convergently inclined relative to the longitudinal axis of the mixing tube in the direction of flow.

3. A burner according to claim 1, wherein the duct is a pipe stub surrounding the nozzle and being concentrically spaced therefrom.

4. A burner according to claim 3, further comprising a channel associated with the openings in the orifice plate, wherein the channel extends alongside of a cone convergent in the direction of flow.

5. A burner according to claim 4, wherein the length of the pipe stub is 10–120% of its inner diameter in the area of the transition of said stub to the openings.

6. A burner according to claim 1, wherein each opening is associated with a separate, corresponding air duct extending smoothly into said opening.

7. A burner according to claim 6, wherein the corresponding air ducts converge conically in the direction of flow.

8. A burner according to claim 7, wherein the air ducts are constituted by chamfers of the openings, the chambers being formed in the orifice plate.

9. A burner according to claim 6, wherein the air ducts are made in a guide common to all ducts and concentrically surrounding the nozzle.

10. A burner according to claim 6, wherein the length of each air duct is 0.5–4 times the radial spacing of the openings from the longitudinal axes of the nozzle.

11. A burner according to claim 1, wherein the orifice plate has an annular slot concentrically surrounding the nozzle and is directly adjacent thereto, the annular slot being in communication with the precombustion chamber.

12. A burner according to claim 1, wherein the peripheral spacing of the neighbouring openings amounts to more than 100% of the diameter of the openings.

13. A burner according to claim 1 or claim 8, wherein the diameter of the upstream end of the mixing tube is greater than the diameter of its downstream end.

14. A burner according to claim 1 or claim 8, wherein:

(a) the diameter of the upstream end of the mixing tube is greater than the diameter of its downstream end; and (b) the mixing tube converges step-wise.

15. A burner as claimed in claim 1 or claim 8, wherein:

(a) the diameter of the upstream end of the mixing tube is greater than the diameter of its downstream end; and (b) the mixing tube converges conically.

16. A burner according to claim 1 or claim 8, wherein:

(a) the diameter of the upstream end of the mixing tube is greater than the diameter of its downstream end; and (b) the inner diameter of the upstream end of the mixing tube is greater than the diameter of a circumferential circle that encloses and is adjacent to the peripheries of the openings.

17. A burner according to claim 1 or claim 8, wherein:

(a) the diameter of the upstream end of the mixing tube is greater than the diameter of its downstream end; and (b) the diameter of the upstream end of the mixing tube is equal to the diameter of a circumferential circle that encloses and is adjacent to the peripheries of the openings.

18. A burner according to claim 1 or claim 8, wherein the length of the mixing tube is up to three times the inner diameter of the inlet of the mixing tube.

19. A burner according to claim 1 or claim 8, wherein:

(a) the length of the mixing tube is up to three times the inner diameter of the inlet of the mixing tube; and (b) the burner comprises an ignition device projecting into the mixing tube through openings provided in the wall of the tube.

20. A burner according to claim 1 or claim 8, wherein recirculation ports are provided in the wall of the mixing tube at its upstream end which is connected to the orifice plate, the ports being spaced from the orifice plates so that a closed tubular portion is disposed between the plate and said recirculation ports.

21. A burner according to claim 1 or claim 8, wherein:

(a) recirculation ports are provided in the wall of the mixing tube at its upstream end which is connected to the orifice plate, the ports being spaced from the orifice plate so that a closed tubular portion is disposed between the plate and said recirculation ports; and (b) the length of the tubular portion is about $\frac{1}{4}$ of the diameter of the mixing tube.

22. A burner according to claim 1 or claim 8, wherein a further tubular portion is associated with the mixing tube at its downstream end, the diameter of the tubular portion not exceeding the diameter of the downstream end of the mixing tube.

23. A burner according to claim 1 or claim 8, wherein:

(a) a further tubular portion is associated with the mixing tube at its downstream end, the diameter of the tubular portion not exceeding the diameter of the downstream end of the mixing tube; and (b) the tubular portion is spaced from the downstream end of the mixing tube, the spacing amounting to 1/10–$\frac{1}{4}$ of the diameter of the mixing tube.

24. A burner according to claim 1 or claim 8, wherein:

(a) a further tubular portion is associated with the mixing tube at its downstream end, the diameter of the tubular portion not exceeding the diameter of the downstream end of the mixing tube; and (b) the length of the tubular portion is equal to from one-half to one times the diameter of the mixing tube, and preferably equal to $\frac{2}{3}$ of the diameter of the mixing tube.

* * * * *